US011015782B2

(12) United States Patent
De Bevilacqua et al.

(10) Patent No.: US 11,015,782 B2
(45) Date of Patent: May 25, 2021

(54) LIGHTING DEVICE

(71) Applicant: ARTEMIDE S.p.A., Milan (IT)

(72) Inventors: Carlotta Francesca Isolina Maria De Bevilacqua, Milan (IT); Andrea Gallucci, Guanzate (IT); Damiano Lavizzari, Cesano Maderno (IT)

(73) Assignee: ARTEMIDE S.P.A, Milan (IT)

( * ) Notice: Subject to any disclaimer, the term of this patent is extended or adjusted under 35 U.S.C. 154(b) by 0 days.

(21) Appl. No.: 16/843,473

(22) Filed: Apr. 8, 2020

(65) Prior Publication Data

US 2020/0326052 A1 Oct. 15, 2020

(30) Foreign Application Priority Data

Apr. 9, 2019 (IT) ..... 102019000005434

(51) Int. Cl.
*F21V 5/00* (2018.01)
*F21V 5/04* (2006.01)
*F21Y 115/10* (2016.01)

(52) U.S. Cl.
CPC ..... *F21V 5/008* (2013.01); *F21V 5/043* (2013.01); *F21Y 2115/10* (2016.08)

(58) Field of Classification Search
None
See application file for complete search history.

(56) References Cited

U.S. PATENT DOCUMENTS 7,963,680 B2 * 6/2011 Yoon ..... G02B 19/0061 362/336
8,070,329 B1 * 12/2011 Bechtel ..... F21V 5/008 362/331
2012/0051066 A1 * 3/2012 Koo ..... G02B 19/0028 362/311.02
2013/0258676 A1 * 10/2013 Hyun ..... G02B 19/0028 362/309
2014/0268810 A1 * 9/2014 Marquardt ..... F21V 7/22 362/308
2014/0293607 A1 10/2014 Wang He

FOREIGN PATENT DOCUMENTS

EP 2613077 A1 7/2013
EP 2905529 A1 8/2015
WO WO2015113852 A1 8/2015

OTHER PUBLICATIONS

Italian Search Report and Written Opinion issued by Ministero dello Sviluppo Economico for Italian Application No. 201900005434, dated Oct. 31, 2019, pp. 1-7.

* cited by examiner

*Primary Examiner* — Elmito Breval
(74) *Attorney, Agent, or Firm* — The Belles Group, P.C.

(57) ABSTRACT

A lighting device extends substantially along a first axis and comprises a LED light source, which has a substantially hemispheric emission on a side of an emission plane, and an optical group, which is placed in front of the light source; the optical group is configured so as to intercept the light emitted by the light source and generate a light ring, which extends at 360° around the light source on opposite sides of the emission plane and is substantially parallel to a meridian plane, which is perpendicular to the emission plane and goes through the axis of the lighting device.

15 Claims, 4 Drawing Sheets

LIGHTING DEVICE

CROSS-REFERENCE TO RELATED APPLICATIONS

This patent application claims priority from Italian Patent Application No. 102019000005434 filed on Apr. 9, 2019, the entire disclosure of which is incorporated herein by reference.

TECHNICAL FIELD

The invention relates to a lighting device.

In particular, the invention relates to a lighting device capable of generating 360° annular light projection.

BACKGROUND ART

In the lighting industry (for indoor and outdoor products), there always is a need for technical solutions that allow for modern light effects and/or particular spectacular results, since not only the merely functional aspect, but also and the aesthetic as well as emotional aspect being crucial for this industry.

For instance, lighting devices are known, which create blades of light and light projections with different shapes, which are used, for example, on building façades or on walls in general, even indoor.

In order to create 360° loop light effects, whether with the shape of a ring or of a frame, it is necessary, with known devices, to use complicated solutions, for example using LED strips closed in a ring shape or shaped so as to have the desired form.

These solutions are relative complicated to be manufactured and installed.

DISCLOSURE OF INVENTION

The object of the invention is to provide a lighting device, which can overcome the drawbacks of the prior art.

In particular, the object of the invention is to provide an extremely compact lighting device, which is simple and efficient as well as capable of generating, starting from a localized source, for example a LED source, a 360° ring-like or frame-like light effect around the source, in a simple and fully efficient manner.

Therefore, the invention relates to a lighting device as basically set forth in appended claim 1 and, for its preferred aspects, in the dependent claims.

The lighting device according to the invention allows for the generation of a defined light projection closed in a 360° ring shape around the source, which is a substantially punctiform source (in particular, a LED source having one or more LEDs).

Therefore, the invention allows a 360° light ring to be generated using one single emitting source, which emits in a half plane, hence over a 180° angle.

Furthermore, the lighting device according to the invention is extremely compact, simple and highly efficient.

The lighting device according to the invention is suited to create decorative and spectacular effects of different types, in particular in architectural applications. For example, with the lighting device according to the invention it is possible to highlight, with a selective lighting, the inner surfaces of openings and recesses made in walls of buildings (doors and windows, niches, etcetera).

The geometry of the light is obtained with an optical assembly basically consisting of two refractor elements: a first lens (a toroidal lens, meaning that it is defined by a torus portion), which further opens the natural Lambertian emission of the (LED) light source, and a second lens (a biconical lens, meaning that it has optical surfaces with double curvature) with the function of collimating in a plane orthogonal to the lens and further opening the light beam in a plane parallel to the lens.

In this way, successive refractions in the two refractors bend the beams by more than 90° relative to the normal to the emission plane of the light source in the plane parallel to the optical assembly.

Basically, there is a partial use of a so-called fish-eye optical system scheme in the plane parallel to the lens, whereas a classic collimating scheme is used in the orthogonal plane.

The lighting device according to the invention is further capable of generating a high illuminance (in the order of some hundreds of lux) even with LEDs with a small power and, hence, has a high ratio between illuminance and supplied electrical power.

BRIEF DESCRIPTION OF THE DRAWINGS

Further features and advantages of the invention will be best understood upon perusal of the following description of a non-limiting embodiment thereof, with reference to the accompanying drawing, wherein.

BEST MODE FOR CARRYING OUT THE INVENTION

Figure 2:
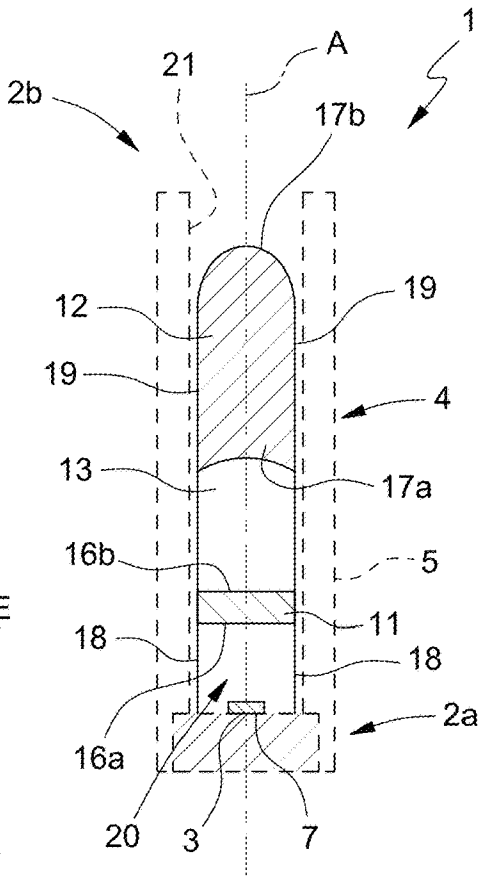
FIG. 2 is a schematic cross section view, with parts removed for greater clarity, of the lighting device of FIG. 1.
Figure 1:
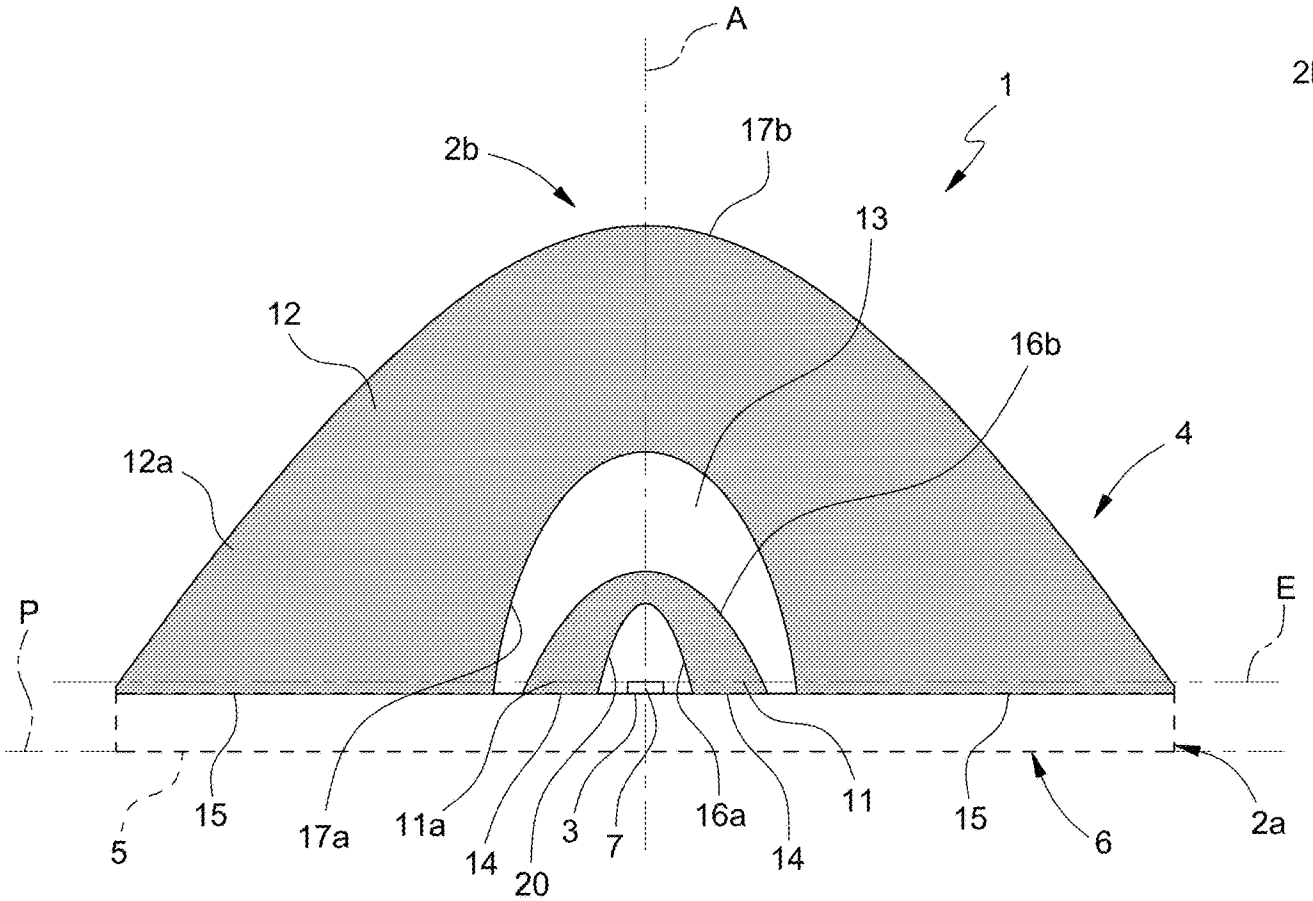
FIG. 1 is a schematic side elevation view, with parts removed for greater clarity, of a lighting device according to the invention.

In FIGS. 1 and 2, number 1 indicates, as a whole, a lighting device substantially extending along an axis A between two opposite ends 2*a*, 2*b*.

The lighting device 1 comprises a light source 3, which is substantially arranged along the axis A at the end 2*a*, and an optical assembly 4, which is placed in front of the light source 3.

The lighting device 1 further comprises a support structure 5, shown in FIGS. 1 and 2 with broken lines and in a merely schematic way, which supports and contains the light source 3 and the optical assembly 4 and has an outer surface 6 defining a support plane P of the lighting device 1.

The light source 3 preferably is a LED light source comprising one or more LEDs 7. The light source 3 can include one single LED 7 or even different LEDs 7, even having a different spectrum of emission, for example three RGB LEDs arranged in a row along an axis that is parallel to the support plane P.

Figure 3:
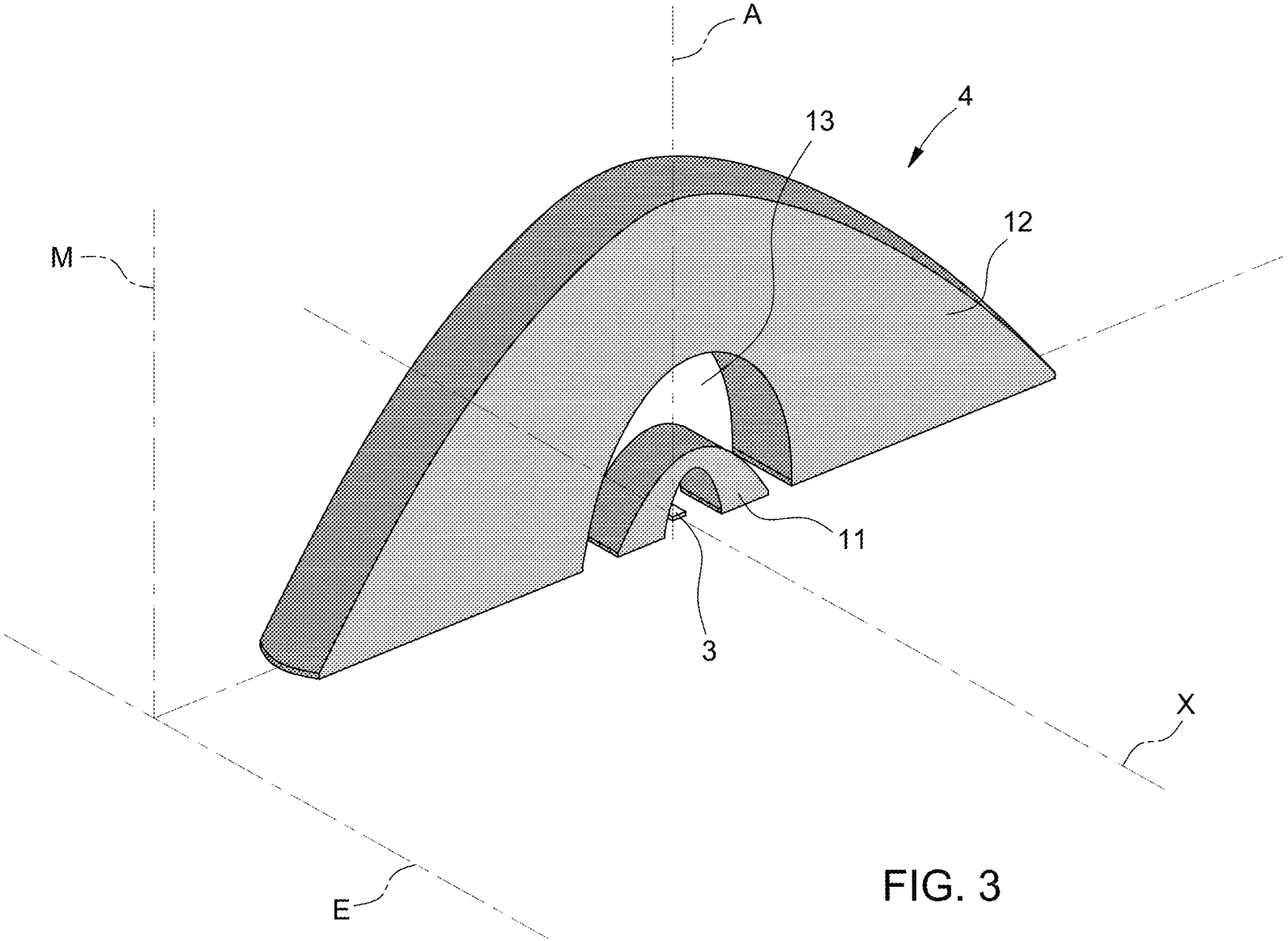
FIG. 3 is a schematic perspective view, with parts removed for greater clarity, of the lighting device of FIG. 1.

With reference to FIG. 3, the light source 3 typically has a substantially hemispherical emission along and around the axis A and above (i.e., on one side of) an emission plane E, which, in this case, is parallel to the support plane P.

The optical assembly 4 is configured so as to intercept the light emitted by the light source 3 and generate a light ring, which extends at 360° around the light source 3 on opposite sides of the emission plane E and is substantially parallel to a meridian plane M, which is perpendicular to the emission plane E and containing the axis A of the lighting device 1.

In particular, the optical assembly 4 is configured so as to generate a 360° light ring closed around the light source 3 and around a transverse axis X, which is perpendicular to the axis A and parallel to the emission plane E and orthogonal to the meridian plane M.

In this way, the light emission of the lighting device 1 extends both above and under the emission plane E, namely also under the light source 3. Clearly, the emission plane E and the support plane P are not necessarily horizontal, but can anyway be oriented, also depending on how the lighting device 1 is installed in use; therefore, expressions such as "above" and "under" and other similar expressions used hereinafter do not necessarily relate to a vertical arrangement, but simply indicate one part or the other of a plane (in particular, of the emission plane E).

The optical assembly 4 comprises, in particular, a pair of lenses 11, 12, which are arranged in series one after the other in front of the light source 3; the lenses 11, 12 are placed inside one another and are spaced apart from one another by an air gap 13.

The lenses 11, 12 generically are arc-shaped around the axis X and extend substantially parallel to the meridian plane M of the lighting device 1.

The lens 11 directly faces the light source 3 and is interposed between the light source 3 and the lens 12.

If the light source 3 includes three RGB LEDs, they are arranged in a row parallel to the meridian plane M.

Each lens 11, 12 has an arc-shaped refracting body 11*a*, 12*a*, which has, in particular, the shape of a donkey-back bridge and extends substantially parallel to the meridian plane M of the lighting device 1 and along the axis A.

The refracting bodies 11*a*, 12*a* of the lenses 11, 12 comprise: respective pairs of base surfaces 14, 15, which are flat and parallel, are placed on opposite sides of the axis A and are perpendicular to the axis A as well as parallel to the emission plane E; respective pairs of curved optical surfaces 16*a*, 16*b* and 17*a*, 17*b*, which originate from respective opposite sides of the base surfaces 14, 15; and respective pairs of opposite lateral sides 18, 19, which laterally join the optical surfaces 16*a*, 16*b* and 17*a*, 17*b*, respectively.

In particular, the lenses 11, 12 have respective inner optical surfaces 16*a*, 17*a*, which are concave and curved around the axis X, and respective outer optical surfaces 16*b*, 17*b*, which are convex and curved around the axis X, opposite one another.

The lenses 11, 12 further have respective pairs of opposite lateral sides 18, 19, which are substantially flat and parallel to one another and to the meridian plane M and join the optical surfaces 16*a*, 16*b* of the lens 11 and the optical surfaces 17*a*, 17*b* of the lens 12, respectively.

The inner optical surface 16*a* of the lens 11 faces the light source 3 and defines a recess 20, which houses the light source 3.

The outer optical surface 16*b* of the lens 11 faces the inner surface 17*a* of the lens 12.

Figure 4:
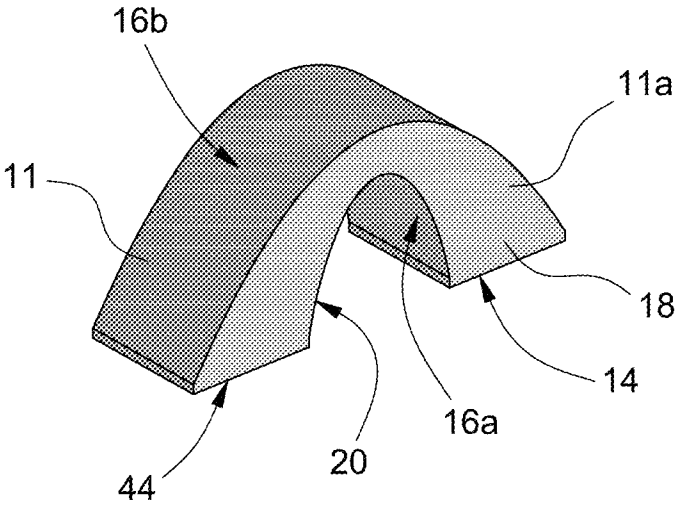

With reference to FIG. 4, the lens 11 can be considered as a toroidal lens, meaning that it is defined by a torus portion.

The optical surfaces 16*a*, 16*b* are both curved on one single plane; in particular, the optical surfaces 16*a*, 16*b* are curved only around the axis X, but not between the sides 18; therefore, the lens 11 has a quadrangular cross section with right angles and straight as well as parallel opposite sides (a substantially rectangular or square cross section).

The optical surfaces 16*a*, 16*b* have a different shape, in particular they have a different profile of curvature.

The lens 11 is shaped so as to collect the light emitted by the light source 3 and open (widen), relative to the axis A, the natural (Lambertian) emission of the light source 3, in particular in a plane that is parallel to the meridian plane M.

In other words, the lens 11 is shaped so as to radially deflect the light beams emitted by light source 3 towards the outside relative to the axis A on planes that are parallel to the meridian plane M.

The lens 12 surrounds the lens 11 and the inner optical surface 17*a* of the lens 12 faces the outer optical surface 16*b* of the lens 11.

The outer optical surface 17*b* of the lens 12, on the other hand, defines a light output surface of the lighting device 1, which faces a slit-shaped opening 21, which is obtained in the support structure 5 at the end 2*b*.

Figure 5:
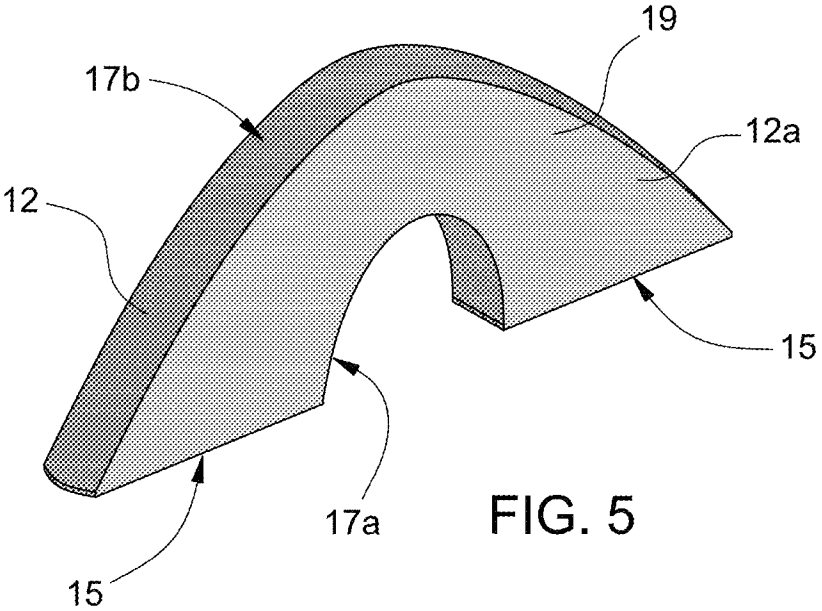
FIGS. 4 and 5 are out-of-scale perspective views of respective components of the lighting device of FIG. 1.

With reference to FIG. 5, the lens 12 can be considered as a biconical lens, meaning that it has optical surfaces with double curvature.

Indeed, the optical surfaces 17*a*, 17*b* have a double curvature, namely they are curved on two planes that are orthogonal to one another: in particular, the optical surfaces 17*a*, 17*b* are both curved both around the axis X and between the sides 19; therefore, the lens 12 has a substantially quadrangular cross section with two curved opposite sides.

The optical surfaces 17*a*, 17*b* have a different shape, in particular they have a different profile of curvature.

The lens 12 is shaped so as to collimate the light coming out of the lens 11 in a plane that is orthogonal to the lens 12, namely on planes that are perpendicular to the sides 19; and so as to further open the light beam coming out of the lens 11 relative to the axis A in a plane that is parallel to the lens 12, namely on planes that are parallel to the meridian plane M.

Figure 6:
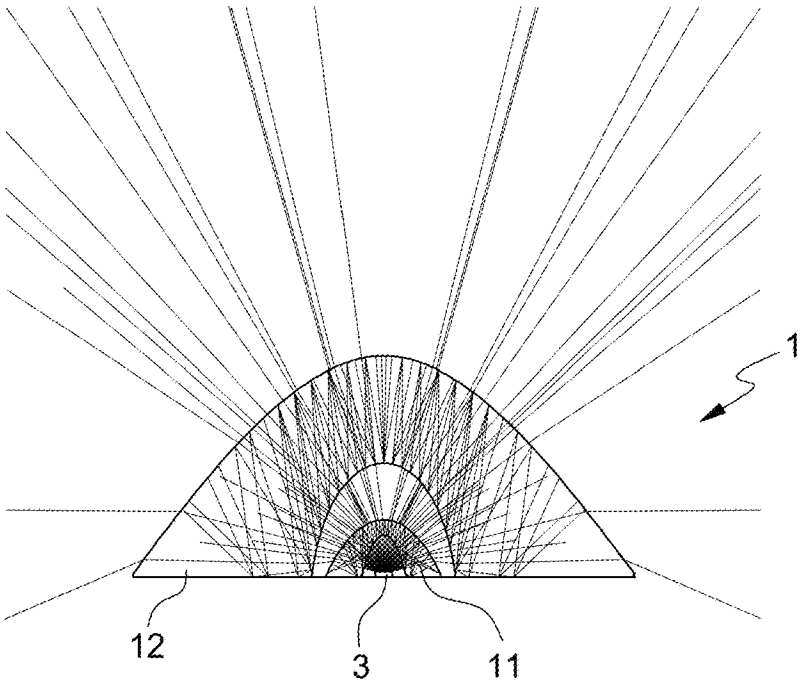
FIG. 6 schematically shows the lighting device of FIG. 1 in use, with indication of some light beams.

In this way, successive refractions in the two lenses 11, 12 bend the beams by more than 90° relative to the normal to the emission plane E of the light source 3 in the plane parallel to the optical assembly 4, as it is schematically shown in FIG. 6.

Figure 7:
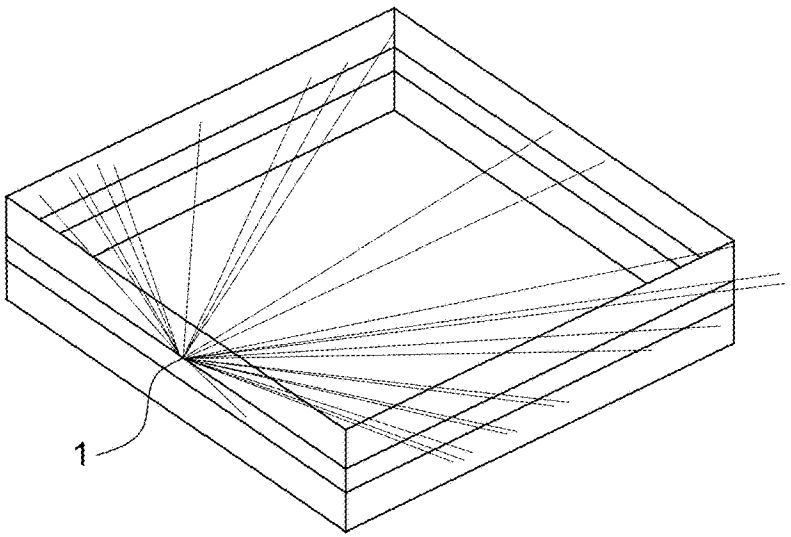
FIG. 7 schematically shows an example of application of the lighting device of FIG. 1.

In this way, a ring-shaped light beam is obtained, which can be used, for example, according to FIG. 7, to highlight, with a selective lighting, an inner surface of a wall opening.

The lighting device described and shown herein can be subjected to further changes and variants, which do not go beyond the scope of protection set forth in the appended claims.

The invention claimed is:

1. A lighting device, extending substantially along a first axis (A) and comprising a LED light source having a substantially hemispheric emission on a side of an emission plane (E), and an optical group positioned in front of the light source;

wherein the optical group is configured so as to receive light from the light source and generate a light ring extending 360° about the light source on opposite sides of the emission plane (E) and substantially parallel to a meridian plane (M), perpendicular to the emission plane (E) and containing the axis (A), of the lighting device so that the light emission of the lighting device extends both above and under the emission plane (E) and the light source.

2. A lighting device according to claim 1, wherein the optical group is configured so as to generate a light ring defined by a 360° loop about the light source and about a transverse axis (X) perpendicular to the axis (A) and parallel to the emission plane (E) and substantially parallel to the meridian plane (M).

3. A lighting device according to claim 1, wherein the optical group comprises a first lens and a second lens arranged in series in front of the light source and positioned one inside the other and spaced from one another by an air gap.

4. A lighting device according to claim 3, wherein the first lens is shaped so as to collect the light emitted by the light source and widen with respect the axis (A) the natural emission of the light source, in particular in a plane parallel to the meridian plane (M).

5. A lighting device according to claim 3, wherein the second lens is shaped so as to collimate the light exiting from the first lens in a plane perpendicular to the second lens; and to further widen the light beam exiting from the first lens with respect to the axis (A) in a plane parallel to the second lens.

6. A lighting device according to claim 3, wherein the lenses are substantially arc-shaped about a transverse axis (X) and extend substantially parallel to the meridian plane (M) of the lighting device.

7. A lighting device according to claim 3, wherein the lenses have respective inner optical surfaces, concave and curved about a transverse axis (X), and respective outer optical surface, convex and curves about the transverse axis (X), opposite with respect to one another; and respective pairs of opposite lateral sides, substantially plane and parallel to one another and to the meridian plane (M) and joining the optical surfaces of the first lens and, respectively, the optical surfaces of the second lens.

8. A lighting device according to claim 7, wherein the optical surfaces of the first lens are both curved on a plane only.

9. A lighting device according to claim 7, wherein the optical surfaces of the first lens have different shapes from each other, having different profile of curvature.

10. A lighting device according to claim 7, wherein the optical surfaces of the second lens have a double curvatures and are curved on two planes perpendicular to each other.

11. A lighting device according to claim 7, wherein the optical surfaces of the second lens have different shapes from each other, having different profile of curvature.

12. A lighting device, extending substantially along a first axis (A) and comprising a LED light source having a substantially hemispheric emission on a side of an emission plane (E), and an optical group positioned in front of the light source; wherein the optical group is configured so as to receive light from the light source and generate a light ring extending 360° about the light source on opposite sides of the emission plane (E) and substantially parallel to a meridian plane (M), perpendicular to the emission plane (E) and containing the axis (A), of the lighting device;

wherein the optical group comprises a first lens and a second lens having respective inner optical surfaces, concave and curved about the transverse axis (X), and respective outer optical surface, convex and curves about a transverse axis (X), opposite with respect to one another; and respective pairs of opposite lateral sides, substantially plane and parallel to one another and to the meridian plane (M) and joining the optical surfaces of the first lens and, respectively, the optical surfaces of the second lens.

13. A lighting device according to claim 12, wherein the optical surfaces of the first lens have different shapes from each other, having different profile of curvature.

14. A lighting device according to claim 12, wherein the optical surfaces of the second lens have a double curvature and are curved on two planes perpendicular to each other.

15. A lighting device according to claim 12, wherein the optical surfaces of the second lens have different shapes from each other, having different profile of curvature.

* * * * *